US006720929B2

(12) United States Patent
Nybeck et al.

(10) Patent No.: US 6,720,929 B2
(45) Date of Patent: Apr. 13, 2004

(54) COMPACT DUAL MODE INTEGRATED ANTENNA SYSTEM FOR TERRESTRIAL CELLULAR AND SATELLITE TELECOMMUNICATIONS

(75) Inventors: James L. Nybeck, Santee, CA (US); Ernest T. Ozaki, Poway, CA (US); Mohammad A. Tassoudji, Cardiff, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/940,379

(22) Filed: Aug. 27, 2001

(65) Prior Publication Data

US 2002/0030629 A1 Mar. 14, 2002

Related U.S. Application Data

(63) Continuation of application No. 09/401,577, filed on Sep. 22, 1999, now Pat. No. 6,320,549.
(60) Provisional application No. 60/127,473, filed on Mar. 13, 1999.

(51) Int. Cl.[7] ..... H01Q 21/00
(52) U.S. Cl. ..... 343/727; 343/895; 343/702
(58) Field of Search ..... 343/727, 895, 343/702, 730, 841, 893

(56) References Cited

U.S. PATENT DOCUMENTS

| | | | | |
|---|---|---|---|---|
| 5,440,317 A | | 8/1995 | Jalloul et al. | 343/791 |
| 5,812,097 A | * | 9/1998 | Maldonado | 343/790 |
| 6,100,847 A | * | 8/2000 | Sointula | 343/702 |
| 6,172,651 B1 | * | 1/2001 | Du | 343/850 |
| 6,215,451 B1 | * | 4/2001 | Hadzoglou | 343/715 |
| 6,320,549 B1 | * | 11/2001 | Nybeck et al. | 343/727 |
| 6,336,036 B1 | * | 1/2002 | Hayes | 455/550 |

FOREIGN PATENT DOCUMENTS

| | | |
|---|---|---|
| EP | 0845870 | 6/1998 |
| GB | 2339969 | 2/2000 |
| JP | 04134906 | 5/1992 |
| JP | 10290115 | 10/1998 |

OTHER PUBLICATIONS

Patent Abstracts of Japan vol. 016, No. 403 (E–1254), Aug. 26, 1992 & JP 04 134906 A (Nippon Telegr & Teleph Corp.), May 8, 1992 Abstract; Figure 8.
Patent Abstracts of Japan vol. 1999 No. 01, Jan. 29, 1999 & JP 10 290115 A (Goto Naohisa; Kyocera Corp), Oct. 27, 1998 Abstract; Figures 1–4.

* cited by examiner

*Primary Examiner*—Tuyet T. Vo
(74) *Attorney, Agent, or Firm*—Philip R. Wadsworth; Gregory D. Ogrod; Jae-Hee Choi

(57) ABSTRACT

The present invention represents an integrated antenna assembly comprising a cellular communications antenna and a satellite communications antenna. Such an antenna assembly can, therefore, be used for communications over either frequency range. A wireless telephone using this assembly can, therefore, operate with either a terrestrial cellular communications system or a satellite communications system. In a preferred embodiment of the invention, the satellite communications antenna is a quadrifilar helix antenna and the cellular communications antenna is a sleeve dipole. The whip portion of the sleeve dipole is positioned axially in the center of the quadrifilar helix antenna. This orientation permits operation in both the satellite and cellular frequency ranges without significant electromagnetic coupling.

16 Claims, 3 Drawing Sheets

COMPACT DUAL MODE INTEGRATED ANTENNA SYSTEM FOR TERRESTRIAL CELLULAR AND SATELLITE TELECOMMUNICATIONS

This application is a continuation of U.S. patent application Ser. No. 09/401,577, filed Sep. 22, 1999, now U.S. Pat. No. 6,320,549, which claims benefit to U.S. Provisional Application Ser. No. 60/127,473 filed Mar. 31, 1999, which is incorporated herein by reference in its entirety.

BACKGROUND OF THE INVENTION

I. Field of the Invention

The present invention relates to antenna technology. In particular, the invention relates to the integration of multiple antennas to allow communications over multiple frequency ranges.

II. Related Art

In recent years there has been significant growth in the availability and use of terrestrial cellular wireless services. At the same time, a new generation of satellite-based telephony systems is becoming available. As a result there is a growing need for wireless devices such as wireless telephone equipment capable of accessing services offered by both terrestrial cellular and satellite-based telecommunication systems. The antennas used by this equipment must, therefore, be capable of dual-mode, dual frequency operation.

A number of problems arise when attempting to meet this need with current antenna technologies. A single antenna aperture design covering both the cellular frequency range (approximately 824 to 960 MHz) and typical satellite communications bands (for example, 2484 to 2500 MHz) would require multioctave bandwidth operation. In addition, the aperture would require dual polarization capabilities since the preferred polarization is different for each mode. Vertical polarization is commonly used for cellular communications, and circular polarization typically used for satellite communications. Supporting both kinds of communications is extremely difficult with a single antenna assembly. Stacked microstrip patch antennas are a possibility, since they offer the potential for dual-band operation. When considering the implementation of such antennas in handheld wireless devices or phones, however, their sizes at cellular frequencies are prohibitive.

If separate wire-type antennas such as dipoles, monopoles, or helix antennas are used to service each frequency band, the electromagnetic coupling between the two antennas could cause severe distortion in the antennas' respective radiation patterns, thereby reducing the effectiveness of each antenna. For handheld phones, this means that one antenna would have to be retracted while the other is deployed, to minimize the deleterious effects of electromagnetic coupling. For fixed and vehicular applications, separate antennas imply multiple installation sites with one antenna physically displaced far enough away from the other to minimize the interaction between them. Multiple antenna installations increase the size, cost, and complexity of the telephone installation.

Consequently, there is a need for an antenna assembly that permits communications over both cellular and satellite frequency ranges, and is physically compact, but does not suffer from electromagnetic coupling problems when operating in either range.

SUMMARY OF THE INVENTION

The present invention represents an integrated antenna assembly comprising a cellular communications antenna and a satellite communications antenna. Such an antenna assembly can therefore be used for communications over either frequency range. A wireless telephone using this assembly can, therefore, operate with either a terrestrial cellular communications system or a satellite communications system. In a preferred embodiment of the invention, the satellite communications antenna is a quadrifilar helix antenna and the cellular communications antenna is a sleeve dipole. The whip portion of the sleeve dipole is positioned axially in the center of the quadrifilar helix antenna. This orientation permits operation in both the satellite and cellular frequency ranges without significant electromagnetic coupling.

Features and Advantages

The invention has the feature of providing cellular and satellite frequency capability in a single antenna assembly.

The invention has the additional feature of providing electromagnetic interference protection to circuitry incorporated in the antenna assembly, such as signal filtering and low-noise amplification circuitry.

The invention has the advantage of providing dual frequency operation in such a manner that electromagnetic coupling between antennas is minimal.

The invention has the further advantage of providing dual frequency operation in an antenna assembly that is relatively compact.

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

I. Overview

This invention addresses the need for an antenna assembly that permits both cellular and satellite communications and can be embodied in a single, compact apparatus. This is accomplished by using either a sleeve dipole or a monopole antenna to provide cellular connectivity, and using a quadrifilar helix antenna for satellite connectivity. The wire (or "whip") portion of the cellular antenna is positioned axially in the center of the quadrifilar helix antenna. This arrangement minimizes electromagnetic coupling between the two antennas, while at the same time minimizing the size of the overall assembly. Specific embodiments of the invention are described below.

II. Combination of Dipole and Quadrifilar Helix Antennas

The cellular antenna of the invention can be embodied by a dipole antenna. As will be described in this section, a sleeve dipole is particularly useful in combination with a quadrifilar helix antenna, where the latter is used for satellite communications. Such a combination minimizes electromagnetic coupling and permits efficient physical packaging.

With respect to satellite communications, a single quadrifilar helix antenna can be employed if the antenna assembly is to be used in receive-only operation. A second quadrifilar helix antenna may also be added to the assembly. This allows the first quadrifilar helix antenna to be dedicated to reception of satellite RF signals while the second quadrifilar helix antenna can be used for transmission of satellite RF signals.

A. Sleeve Dipole with Receive-Only Quadrifilar Helix Antenna

Figure 1:
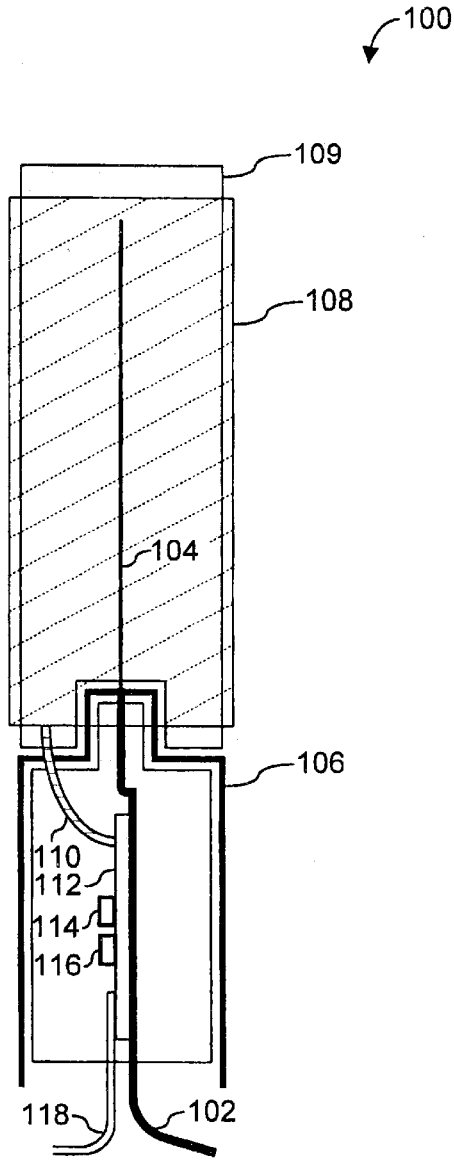
FIG. 1 illustrates the combination of a sleeve dipole antenna and a quadrifilar helix antenna, according to an embodiment of the invention.

A preferred embodiment of the invention comprises a sleeve dipole antenna and a quadrifilar helix antenna. Such an antenna assembly, when connected to a telecommunications device such as a mobile or portable telephone, permits the operation of the telecommunications device over both cellular and satellite frequencies. FIG. 1 illustrates the features of this embodiment. An antenna assembly 100 is generally cylindrical and is shown in lengthwise cross-section. Antenna assembly 100 is connected to the telecommunications device (not shown) by two cables, a coaxial cable 102 and a satellite communications cable 118. A center conductor 104 of coaxial cable 102 passes through the axial center of the upper portion of apparatus 100. The shield of coaxial cable 102 is grounded to the top of a conductive sleeve 106. Center conductor 104 and conductive sleeve 106 collectively constitute a sleeve dipole antenna for cellular communications. The axial length of conductive sleeve 106 and center conductor 104 are each nominally one quarter wavelength at cellular frequencies. This antenna radiates null-on-axis radiation patterns ideally suited for cellular applications, and provides vertically polarized, omni-azimuthal coverage with peak gain near the horizon.

In the embodiment shown in FIG. 1, center conductor 104 is surrounded by a quadrifilar helix antenna 108. Quadrifilar helix antenna 108 permits the attached telecommunications device to operate in the satellite frequency band. Quadrifilar helix antenna 108 provides circularly-polarized, upper hemisphere coverage that is more suitable for satellite communications applications. In the embodiment shown, center conductor 104 and quadrifilar helix antenna 108 are separated by a dielectric core 109.

In some applications of the invention, quadrifilar helix antenna 108 is used in a receive-only mode. This would be the case, for example, if connectivity to the Global Positioning System (GPS) were desired. In such an application, the signal received by quadrifilar helix antenna 108 may require processing in order to improve overall receiver sensitivity. In the embodiment illustrated in FIG. 1, the output of quadrifilar helix antenna 108 is connected by a microstrip 110 to circuitry that is mounted on a printed circuit board (PCB) 112, or similar type of known support substrate. This circuitry comprises a pre-amplification filter 114 and a low-noise amplifier (LNA) 116. The design of these components is well known to those skilled in the relevant art. The output of LNA 116 is then directed to satellite communications cable 118, which is connected to the telecommunications device.

In the embodiment shown in FIG. 1, conductive sleeve 106 shields LNA 116 and filter 114 from outside electromagnetic interference, in addition to serving as the lower part of the dipole antenna. Moreover, the open end of conductive sleeve 106 presents a high impedance to the currents flowing on the outer portion of conductive sleeve 106. In this way, the current flow at the end of conductive sleeve 106 is minimized. This results in minimal coupling to both satellite communications cable 118 and coaxial cable 102, which protrude from conductive sleeve 106. The actual sleeve length may be adjusted to take into account the loading effects of LNA 116 and filter 114 inside conductive sleeve 106.

The electromagnetic coupling of quadrifilar helix antenna 108 to center conductor 104 is reduced due to the nature of the electromagnetic fields in the center of quadrifilar helix antenna 108. Since each filar arm of a diametrically opposed pair of filars is driven out of phase, current on each filar arm of the pair flows in opposite directions. As a result, the axially directed electric fields induced by these currents tend to cancel along the axis of quadrifilar helix antenna 108. Consequently, the coupling to center conductor 104 is minimized. The radiation patterns and gain of quadrifilar helix antenna 108 are, therefore, minimally affected by the presence of the axially mounted center conductor 104.

The coupling of the center conductor 104 to the filar windings themselves is reduced by the fact that the windings are not entirely parallel to the axially directed center conductor 104. For example, maximum coupling would occur if the filar arms were oriented parallel to center conductor 104. Minimum coupling would occur if the filars were orthogonal to the center conductor 104. Since the filars are neither completely parallel nor completely orthogonal to center conductor 104 due to the helical winding pattern or shapes and sometimes variable pitch, the current induced on the filars is weak in comparison to that on the dipole. As a result, the radiation patterns are not affected to the first order. The length of center conductor 104 can be adjusted to account for many filar loading effects that occur.

B. Sleeve Dipole with Receive and Transmit Quadrifilar Helix Antennas

There are other possible embodiments implementing the basic approach of FIG. 1. If transmission capability is desired for satellite communications, and the transmission frequency is different from that of incoming satellite communications, an apparatus analogous to antenna assembly 100 can be stacked on top of a transmit quadrifilar helix antenna as shown in FIG. 2.

An example of a system that requires such an antenna assembly is a low earth orbit (LEO) satellite communication system. One such LEO system uses approximately 48 satellites in eight different orbital planes. This system uses an uplink (transmit) frequency band of 1610 to 1626 MHz while the downlink (receive) frequencies range from 2484 to 2500 MHz. It will be apparent to those skilled in the art that other satellite constellations and/or other frequency bands can be utilized without departing from the spirit or scope of this invention.

Figure 2:
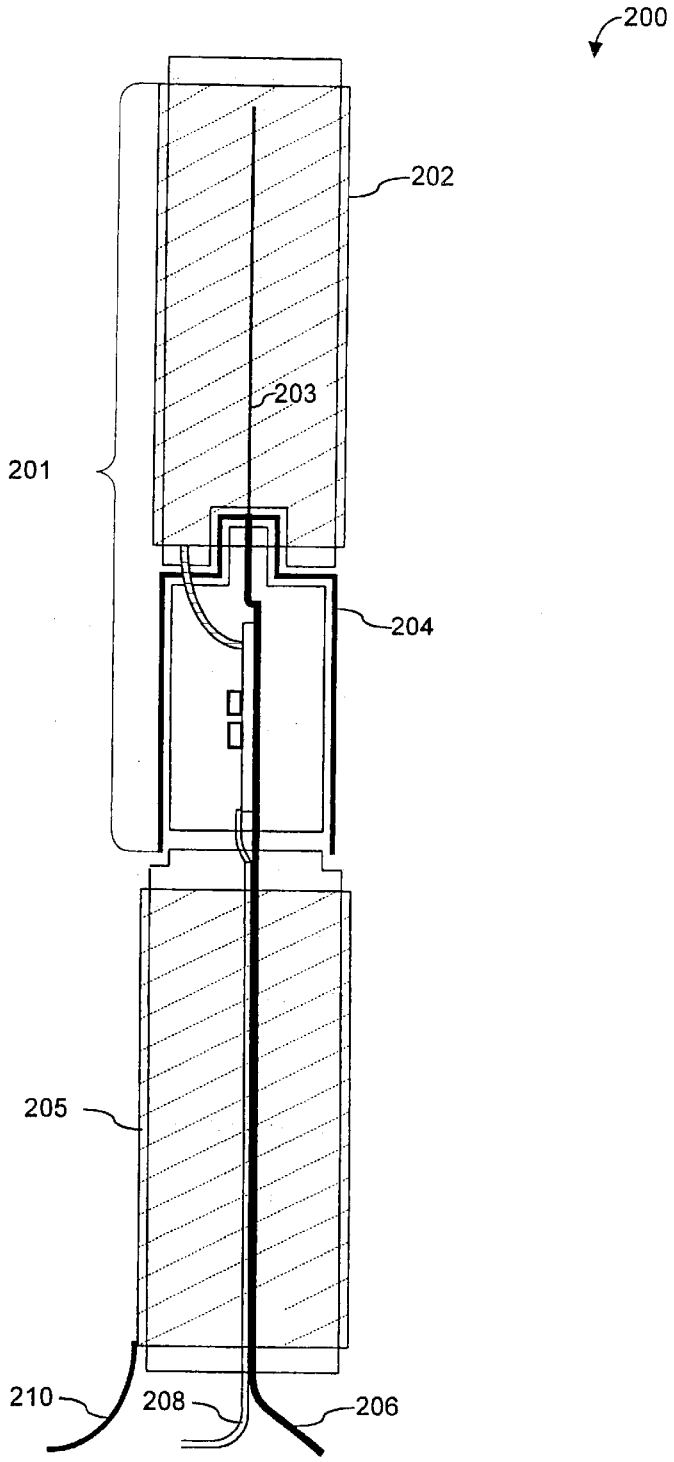
FIG. 2 illustrates the combination of a sleeve dipole antenna and two quadrifilar helix antennas, according to an embodiment of the invention.

In FIG. 2, subassembly 201 corresponds directly to antenna assembly 100 of FIG. 1. Subassembly 201 comprises a receive quadrifilar helix antenna 202, which serves to receive satellite communications. Subassembly 201 also comprises a center conductor 203, and sleeve 204 which collectively form a sleeve dipole antenna which enables cellular communications. A second quadrifilar helix antenna 205 operates as a transmit antenna to transmit RF signals to a satellite. A coaxial cable 206 connects the telecommunications device to sleeve dipole 204. A first satellite communications cable 208 connects the telecommunications device to receive quadrifilar helix antenna 202. A second satellite communications cable 210 connects the telecommunications device to transmit quadrifilar helix antenna 205.

The radiation patterns and gain of transmit quadrifilar helix antenna 205 are minimally affected by the presence of receive quadrifilar helix antenna 202 and sleeve dipole antenna 204 provided that the cables feeding those latter antennas are centered along the axis of transmit quadrifilar helix antenna 205. This "tri-mode" embodiment is ideal for trunk lid mounted vehicular antenna applications where the blockage of a receive antenna by the vehicle rooftop must be minimized.

Note that if transmit quadrifilar helix antenna 205 were on the top of the assembly, electromagnetic coupling could become a problem. In this arrangement (not illustrated), electromagnetic coupling of sleeve dipole antenna 204 to satellite communications cable 210 could degrade the radiation patterns and gain of sleeve dipole antenna 204, since both sleeve dipole antenna 204 and satellite communications cable 210 would be axially oriented.

III. Combination of Monopole and Quadrifilar Helix Antennas

Figure 3:
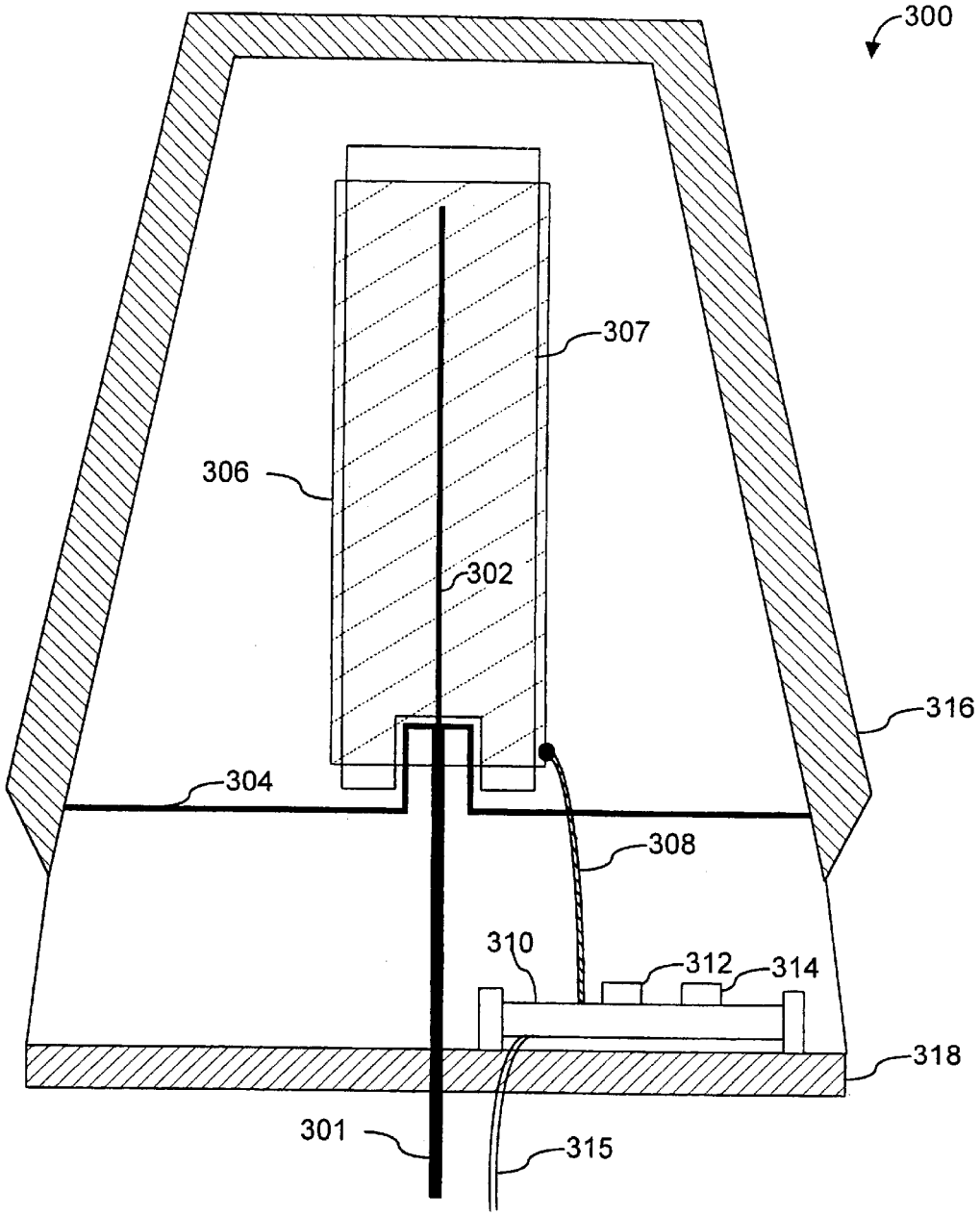
FIG. 3 illustrates the combination of a monopole antenna and a quadrifilar helix antenna, according to an embodiment of the invention.

An embodiment of the invention that is well suited for vehicle rooftop installations is shown in FIG. 3. This embodiment allows for simultaneous reception of satellite signals (such as those from GPS) and access to terrestrial cellular services. This embodiment uses a monopole antenna for cellular communications instead of a sleeve dipole.

In a manner similar to the previously described embodiments, antenna assembly 300 is connected by a coaxial cable 301 to the wireless telecommunications device. As before, a center conductor 302 originates from coaxial cable 301 and resides in the center of antenna assembly 300. Center conductor 302 serves as a monopole antenna for cellular communications. The shield of coaxial cable 301 is connected to a flat conductive top plate 304. A quadrifilar helix antenna 306 surrounds center conductor 302, and is separated from center conductor 302 by a dielectric core 307. Quadrifilar helix antenna 306 is connected by a microstrip 308 to circuitry mounted on a PCB 310. This circuitry comprises a pre-amplification filter 312 and an LNA 314, which serve to improve overall receiver sensitivity, as in the case of the embodiments of FIGS. 1 and 2. The output of this circuitry is fed to a satellite communications cable 315.

The monopole, center conductor 302, radiates null-on-axis vertically polarized patterns while quadrifilar helix antenna 306 provides circularly polarized hemispherical coverage. For the same reasons as those presented in section II.A., the receive satellite communications antenna, quadrifilar helix antenna 306, is substantially unaffected by the presence of center conductor 302, and vice versa.

The apparatus described above is generally covered and protected by a radome 316. A base 318 of the antenna assembly 300 may include a mechanism for attachment (not shown) to a support surface for use. For example, attachment can be accomplished using an array of one or more magnets for attachment to the metallic roof of a vehicle, or similar surface.

IV. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention. Thus, the present invention should not be limited by any of the above-described exemplary embodiments, but should be defined only in accordance with the following claims and their equivalents.

What we claim as our invention is:

1. An integrated antenna assembly comprising:

a cellular communications antenna capable of operating in a cellular frequency range having a first central axis;

a satellite communications antenna capable of operating in a satellite frequency range positioned adjacent to said cellular communications antenna and having a second central axis aligned with said first central axis; and a dielectric core separating the cellular communications antenna from the satellite communications antenna.

2. The antenna assembly of claim 1, wherein said satellite communications antenna comprises a quadrifilar helix antenna for reception of radio frequency signals from a satellite.

3. The antenna assembly of claim 2, wherein said cellular communications antenna comprises a sleeve dipole antenna.

4. The antenna assembly of claim 1, wherein said cellular communications antenna comprises a sleeve dipole antenna.

5. The antenna assembly of claim 1, wherein said cellular communications antenna comprises a monopole antenna.

6. The antenna assembly of claim 1, further comprising:

a circuitry configured to improve overall receiver sensitivity; and a microstrip connecting the satellite communications antenna to the circuitry.

7. The antenna assembly of claim 6, further comprising:

a printed circuit board configured to mount the circuitry.

8. An integrated antenna assembly comprising:

a cellular communications antenna capable of operating in a cellular frequency range having a first central axis, said cellular communications antenna comprising a sleeve dipole antenna;

a quadrifilar helix antenna capable of operating in a satellite frequency range positioned adjacent to said cellular communications antenna and having a second central axis aligned with said first central axis.

9. The antenna assembly of claim 8, further comprising:

a circuitry configured to improve overall receiver sensitivity; and a microstrip connecting the quadrifilar helix antenna to the circuitry.

10. An integrated antenna assembly comprising:

a sleeve dipole antenna capable of operating in a cellular frequency range having a first central axis;

a satellite communications antenna capable of operating in a satellite frequency range positioned adjacent to said sleeve dipole antenna and having a second central axis aligned with said first central axis.

11. The antenna assembly of claim 10, further comprising:

a circuitry configured to improve overall receiver sensitivity; and a microstrip connecting the satellite communications antenna to the circuitry.

12. An integrated antenna assembly comprising:

a cellular communications antenna capable of operating in a cellular frequency range having a first central axis, the cellular communications antenna comprising a sleeve dipole antenna;

a satellite communications antenna capable of operating in a satellite frequency range positioned adjacent to said cellular communications antenna and having a second central axis aligned with said first central axis;

a circuitry configured to improve overall receiver sensitivity; and a microstrip connecting the satellite communications antenna to the circuitry.

13. The antenna assembly of claim 12, wherein said satellite communications antenna comprises a quadrifilar helix antenna for reception of radio frequency signals from a satellite.

14. The antenna assembly of claim 12, wherein said cellular communications antenna comprises a monopole antenna.

15. The antenna assembly of claim 12, further comprising:

a printed circuit board configured to mount the circuitry.

16. The antenna assembly of claim 15, wherein the circuitry comprises:

a pre-amplification filter; and a low-noise amplifier.

* * * * *